US008508327B2

(12) United States Patent
Chen et al.

(10) Patent No.: US 8,508,327 B2
(45) Date of Patent: Aug. 13, 2013

(54) PTC MATERIAL COMPOSITION FOR MAKING A PTC CIRCUIT PROTECTION DEVICE

(75) Inventors: Jack Jih-Sang Chen, New Taipei (TW); Chi-Hao Gu, New Taipei (TW); Chang-Hung Jiang, New Tiapei (TW)

(73) Assignee: Fuzetec Technology Co., Ltd., Taipei County (TW)

( * ) Notice: Subject to any disclaimer, the term of this patent is extended or adjusted under 35 U.S.C. 154(b) by 0 days.

(21) Appl. No.: 13/240,715

(22) Filed: Sep. 22, 2011

(65) Prior Publication Data

US 2013/0021134 A1 Jan. 24, 2013

(30) Foreign Application Priority Data

Jul. 19, 2011 (TW) ..... 100125478 A

(51) Int. Cl.
*H01C 7/10* (2006.01)

(52) U.S. Cl.
USPC ..... 338/22 R; 338/13

(58) Field of Classification Search
USPC ..... 338/22 R, 13; 353/511
See application file for complete search history.

(56) References Cited

U.S. PATENT DOCUMENTS

| | | | | |
|---|---|---|---|---|
| 3,900,552 | A * | 8/1975 | Hunter et al. | 423/76 |
| 4,910,389 | A * | 3/1990 | Sherman et al. | 219/548 |
| 7,286,038 | B1 * | 10/2007 | Wang et al. | 338/22 R |
| 7,352,272 | B2 * | 4/2008 | Wang et al. | 338/22 R |
| 7,382,224 | B2 * | 6/2008 | Wang et al. | 338/22 R |
| 7,632,373 | B2 * | 12/2009 | Galla | 156/278 |

* cited by examiner

*Primary Examiner* — Kyung Lee
(74) *Attorney, Agent, or Firm* — Foley & Lardner LLP

(57) ABSTRACT

A PTC material composition for making a PTC circuit protection device comprises a PTC polymer unit and a conductive filler containing a plurality of titanium carbide particles. The titanium carbide particles have a residual oxygen content greater than 0.3 wt % based on the weight of the titanium carbide particles.

13 Claims, 1 Drawing Sheet

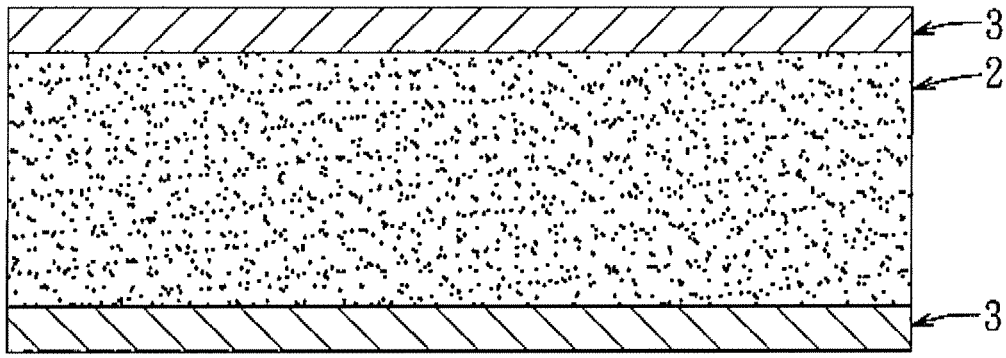
3
2
3

PTC MATERIAL COMPOSITION FOR MAKING A PTC CIRCUIT PROTECTION DEVICE

BACKGROUND OF THE INVENTION

1. Field of the Invention

This invention relates to a positive temperature coefficient (PTC) material composition for making a PTC circuit protection device, more particularly to a FTC material composition containing titanium carbide particles.

2. Description of the Related Art

A positive temperature coefficient (PTC) element exhibits a PTC effect that renders the same to be useful as a circuit protecting device, such as a resettable fuse. The PTC element includes a PTC polymer material and first and second electrodes attached to two opposite surfaces of the PTC polymer material. The FTC polymer material includes a polymer matrix that contains a crystalline region and a non-crystalline region, and a particulate conductive filler dispersed in the non-crystalline region of the polymer matrix and formed into a continuous conductive path for electrical conduction between the first and second electrodes. The PTC effect is a phenomena that when the temperature of the polymer matrix is raised to its melting point, crystals in the crystalline region start melting, which results in generation of a new non-crystalline region. As the new non-crystalline region is increased to an extent to merge into the original non-crystalline region, the conductive path of the particulate conductive filler will become discontinuous and the resistance of the PTC polymer material will sharply increase, thereby resulting in electrical disconnection between the first and second electrodes.

Conventionally, the polymer matrix is made from a polymer composition containing a non-grafted high density polyethylene (HDPE) and optionally a carboxylic acid anhydride grafted HDPE. The grafted HDPE serves to increase adhesion of the PTC polymer material to the electrodes.

Examples of the particulate conductive filler are carbon black, metal powders, conductive ceramic powders, metalized glass beads, etc. Since carbon black has a lower conductivity, the PTC polymer materials using carbon black as the particulate conductive filler will have a resistivity greater than 0.1 ohm-cm. Hence, for PTC circuit protection devices that require the PTC polymer materials to have a resistivity less than 0.1 ohm-cm or even less than 0.05 ohm-cm, carbon black is no longer suitable for use as the particulate conductive filler. Although the conductivity of the PTC polymer material can be considerably increased by using the non-carbon particulate conductive fillers, such as metal powders, these highly conductive non-carbon particulate conductive fillers exhibit a low compatibility with the PTC polymer and may tend to creep in the PTC polymer, thereby resulting in an unstable electrical property of the PTC element and a decrease in the service life of the FTC element.

SUMMARY OF THE INVENTION

Therefore, an object of the present invention is to provide a PTC circuit protection device that can overcome the aforesaid drawback of unstable electrical property associated with the prior art.

According to one aspect of this invention, there is provided a PTC material composition for making a PTC circuit protection device. The PTC material composition comprises a PTC polymer unit and a conductive filler containing a plurality of titanium carbide particles. The titanium carbide particles have a residual oxygen content greater than 0.3 wt % based on the weight of the titanium carbide particles.

According to another aspect of this invention, there is provided a FTC circuit protection device that comprises a PTC material layer and two electrodes attached to the PTC material layer. The PTC material layer has a PTC material composition that includes a PTC polymer unit and a conductive filler containing a plurality of titanium carbide particles. The titanium carbide particles have a residual oxygen content greater than 0.3 wt % based on the weight of the titanium carbide particles.

BRIEF DESCRIPTION OF THE DRAWING

In the drawing which illustrates an embodiment of the invention,

FIG. 1 is a schematic view of the preferred embodiment of a PTC circuit protection device according to this invention.

DETAILED DESCRIPTION OF THE PREFERRED EMBODIMENT

FIG. 1 illustrates the preferred embodiment of a PTC circuit protection device according to this invention. The PTC circuit protection device comprises a PTC material layer 2 and two electrodes 3 attached to the PTC material layer 2. The PTC material layer 2 has a PTC material composition that includes a PTC polymer unit and a conductive filler containing a plurality of titanium carbide particles. The titanium carbide particles have a residual oxygen content greater than 0.3 wt % based on the weight of the titanium carbide particles. The residual oxygen content represents the amount of oxygen present in titanium carbide particles. The titanium carbide particles are formed by carbiding a mixture containing a titanium-containing material and a carbon-containing material under an elevated carbiding temperature. The higher the carbiding temperature, the lower will be the residual oxygen content present in the titanium carbide particles.

Preferably, the residual oxygen content of the titanium carbide particles is greater than or equal to 0.5 wt % and less than 1.0 wt % based on the weight of the titanium carbide particles.

Preferably, the titanium carbide particles are formed by carbiding the mixture containing the titanium-containing material and the carbon-containing material under the carbiding temperature ranging from 1700° C. to 2000° C.

Preferably, the titanium-containing material is selected from the group consisting of titanium dioxide, titanium tetrachloride, titanium hydride, ferro titanium ore, titanium and combinations thereof. More preferably, the titanium-containing material is titanium dioxide.

Preferably, the carbon-containing material is selected from the group consisting of carbon black, graphite and a combination thereof.

Preferably, the PTC polymer unit includes a polyolefin blend including non-grafted HOPE and carboxylic acid anhydride grafted HDPE.

Preferably, the PTC polymer unit is in an amount ranging from 10-30 wt % based on the weight of the PTC material composition, and the conductive filler is in an amount ranging from 70-90 wt % based on the weight of the PTC material composition.

Preferably, the conductive filler further contains a powder of an auxiliary conductive material selected from the group consisting of zirconium carbide, vanadium carbide, niobium carbide, tantalum carbide, chromium carbide, molybdenum carbide, tungsten carbide, titanium nitride, zirconium nitride, vanadium nitride, niobium nitride, tantalum nitride, chromium nitride, titanium disilicide, zirconium disilicide, niobium disilicide, tungsten disilicide, gold, silver, copper, aluminum, nickel, nickel-metallized glass beads, nickel-metallized graphite, Ti—Ta solid solution, W—Ti—Ta—Cr solid solution, W—Ta solid solution, W—Ti—Ta—Nb solid solution, W—Ti—Ta solid solution, W—Ti solid solution, Ta—Nb solid solution, and combinations thereof. More preferably, the auxiliary conductive material is nickel powder.

The following examples and comparative examples are provided to illustrate the preferred embodiment of the invention, and should not be construed as limiting the scope of the invention.

EXAMPLE

Example 1 (E1)

10 grams of HDPE (purchased from Formosa plastic Corp., catalog no.: HDPE9002, having a weight average molecular weight of 150,000 g/mole and a melt flow rate of 45 g/10 min according to ASTM D-1238 under a temperature of 230° C. and a load of 12.6 Kg), 10 grams of carboxylic acid anhydride grafted HDPE (purchased from Dupont, catalog no.: MB100D, having a weight average molecular weight of 80,000 g/mole and a melt flow rate of 75 g/10 min according to ASTM D-1238 under a temperature of 230° C. and a load of 12.6 Kg), and 80 grams of powder A of titanium carbide (hereinafter referred to as TiC-A, which is a product formed by carbiding a mixture of titanium dioxide powder and carbon black powder under 1850° C., and has 0.9 wt % of residual oxygen content) were compounded in a Brabender mixer. The compounding temperature was 200° C., the stirring rate was 60 rpm, and the compounding time was 10 minutes. The compounded mixture was hot pressed in a mold so as to form a thin sheet of the PTC material having a thickness of 0.12 mm. The hot pressing temperature was 200° C., the hot pressing time was 4 minutes, and the hot pressing pressure was 80 kg/cm$^2$. The resistance of the PTC material thus formed was determined (as shown in Table 1). In Table 1, G-HDPE represents carboxylic acid anhydride grafted HDPE and V-R represents the volume resistivity (ohm-cm). Two copper foil sheets were attached to two sides of the thin sheet followed by hot pressing under 200° C. and 80 kg/cm$^2$ for 4 minutes to form a sandwiched structure of a PTC laminate. The PTC laminate was cut into a plurality of test samples (i.e., the PTC circuit protection devices) with a size of 4.5 mm×3.2 mm.

Example 2 (E2)

The procedures and conditions in preparing the test samples of Example 2 were similar to those of Example 1, except that the conductive filler of Example 2 is powder B of titanium carbide (hereinafter referred to as TiC-B, which is a product formed by carbiding a mixture of titanium hydride powder and carbon black powder under 1960° C., and has 0.8 wt % of residual oxygen content). The resistance of the PTC material thus formed was determined (as shown in Table 1).

Example 3 (E3)

The procedures and conditions in preparing the test samples of Example 3 were similar to those of Example 1, except that the conductive filler of Example 3 is powder C of titanium carbide (hereinafter referred to as TiC-C, which is a product formed by carbiding a mixture of Ferro titanium ore powder and graphite powder under 1780° C., and has 0.5 wt % of residual oxygen content). The resistance of the PTC material thus formed was determined (as shown in Table 1).

Comparative Example 1 (CE1)

The procedures and conditions in preparing the test samples of Comparative Example 1 were similar to those of Example 1, except that the conductive filler of Comparative Example 1 is powder D of titanium carbide (hereinafter referred to as TIC-D, which is a product formed by carbiding a mixture of titanium dioxide powder and carbon black powder under 2200° C., and has 0.2 wt % of residual oxygen content). The resistance of the PTC material thus formed was determined (as shown in Table 1).

Example 4 (E4)

The procedures and conditions in preparing the test samples of Example 4 were similar to those of Example 1, except that the conductive filler of Example 4 is a mixture of powder A (60 g) of titanium carbide and nickel powder (20 g). The resistance of the PTC material thus formed was determined (as shown in Table 2).

TABLE 1

| | Polymer 1 | Polymer 1 Wt % | Polymer 2 | Polymer 2 Wt % | Conductive filler | Conductive filler Wt % | Resistance results ohm | Resistance results V-R ohm-cm |
|---|---|---|---|---|---|---|---|---|
| E1 | HDPE | 10 | G-HDPE | 10 | TiC-A | 80.00 | 0.0105 | 0.0280 |
| E2 | HDPE | 10 | G-HDPE | 10 | TiC-B | 80.00 | 0.0093 | 0.0248 |
| E3 | HDPE | 10 | G-HDPE | 10 | TiC-C | 80.00 | 0.0102 | 0.0272 |
| CE1 | HDPE | 10 | G-HDPE | 10 | TiC-D | 80.00 | 0.0108 | 0.0288 |

TABLE 2

| | Polymer 1 (Wt %) | Polymer 2 (Wt %) | Conductive filler 1 (Wt %) | Conductive filler 2 (Wt %) | Resistance results ohm | V-R ohm-cm |
|---|---|---|---|---|---|---|
| E4 | HDPE (10 Wt %) | G-HDPE (10 Wt %) | TiC-A (60.00 Wt %) | Ni (20.00 Wt %) | 0.0112 | 0.0299 |
| E5 | HDPE (10 Wt %) | G-HDPE (10 Wt %) | TiC-B (60.00 Wt %) | Ni (20.00 Wt %) | 0.0107 | 0.0285 |
| E6 | HDPE (10 Wt %) | G-HDPE (10 Wt %) | TiC-C (60.00 Wt %) | Ni (20.00 Wt %) | 0.0105 | 0.0280 |
| CE2 | HDPE (10 Wt %) | G-HDPE (10 Wt %) | — | Ni (80.00 Wt %) | 0.0111 | 0.0296 |
| CE3 | HDPE (10 Wt %) | G-HDPE (10 Wt %) | TiC-D (60.00 Wt %) | Ni (20.00 Wt %) | 0.0104 | 0.0277 |

Example 5 (E5)

The procedures and conditions in preparing the test samples of Example 5 were similar to those of Example 1, except that the conductive filler of Example 5 is a mixture of powder B (60 g) of titanium carbide and nickel powder (20 g). The resistance of the PTC material thus formed was determined (as shown in Table 2).

Example 6 (E6)

The procedures and conditions in preparing the test samples of Example 6 were similar to those of Example 1, except that the conductive filler of Example 6 is a mixture of powder C (60 g) of titanium carbide and nickel powder (20 g). The resistance of the FTC material thus formed was determined (as shown in Table 2).

Comparative Example 2 (CE2)

The procedures and conditions in preparing the test samples of Comparative Example 2 were similar to those of Example 1, except that the conductive filler of Comparative Example 2 is nickel powder (80 g). The resistance of the FTC material thus formed was determined (as shown in Table 2).

Comparative Example 3 (CE3)

The procedures and conditions in preparing the test samples of Comparative Example 3 were similar to those of Example 1, except that the conductive filler of Comparative Example 3 is a mixture of powder D (60 g) of titanium carbide and nickel powder (20 g). The resistance of the FTC material thus formed was determined (as shown in Table 2).

Performance Test

The test samples of Examples 1-6 and Comparative Examples 1-3 were subjected to switching cycle test and aging test. The switching cycle test was conducted under a voltage of 6 Vdc and a current of 50 A by switching on for 60 seconds and then off for 60 seconds for each cycle, and was performed for 7200 cycles. The resistances of each test sample before ($R_i$) and after ($R_f$) the switching cycle test were determined, and the variation percent in resistance of each test sample after the switching cycle test was determined. The aging test was conducted under a voltage of 6 Vdc and a current of 10 A for 504 hours. The resistances of each test sample before ($R_i$) and after ($R_f$) the aging test were determined, and the variation percent in resistance of each test sample after the aging test was determined. The performance test results for Examples 1-3 and Comparative Example 1 are shown in Tables 3 and 4. The performance test results for Examples 4-6 and Comparative Examples 2-3 are shown in Tables 5 and 6.

TABLE 3

| | RI, avg, ohm | Rf, avg, ohm | Rf/Ri, avg, % | Pass ratio, % |
|---|---|---|---|---|
| E1 | 0.008 | 0.0763 | 953.8 | 100 |
| E2 | 0.009 | 0.0565 | 627.8 | 100 |
| E3 | 0.009 | 0.0735 | 816.7 | 100 |
| CE1 | 0.008 | 13.763 | 172037.5 | 92 |

TABLE 4

| | Ri, avg, ohm | Rf, avg, ohm | Rf/Ri, avg, % | Pass ratio, % |
|---|---|---|---|---|
| E1 | 0.008 | 0.214 | 2675.0 | 100 |
| E2 | 0.009 | 0.195 | 2166.7 | 100 |
| E3 | 0.009 | 0.221 | 2455.6 | 100 |
| CE1 | 0.008 | 2.794 | 34925.0 | 98 |

The performance test results of Examples 1-3 and Comparative Example 1 indicate that the electrical properties of Examples 1-3 are more stable than those of Comparative Example 1.

TABLE 5

| | Ri, avg, ohm | Rf, avg, ohm | Rf/Ri, avg, % | Pass ratio, % |
|---|---|---|---|---|
| E4 | 0.009 | 0.0185 | 205.6 | 100 |
| E5 | 0.009 | 0.0149 | 165.6 | 100 |
| E6 | 0.009 | 0.0204 | 226.7 | 100 |
| CE2 | 0.007 | 0.4496 | 6422.9 | 70 |
| CE3 | 0.008 | 35.97 | 449625.0 | 92 |

TABLE 6

| | Ri, avg, ohm | Rf, avg, ohm | Rf/Ri, avg, % | Pass ratio, % |
|---|---|---|---|---|
| E4 | 0.008 | 0.0948 | 1185.0 | 100 |
| E5 | 0.008 | 0.1085 | 1356.3 | 100 |
| E6 | 0.009 | 0.1343 | 1492.2 | 100 |
| CE2 | 0.007 | 69.83 | 997571.4 | 86 |
| CE3 | 0.008 | 98.56 | 1232000.0 | 98 |

The performance test results of Examples 4-6 and Comparative Examples 2-3 indicate that the electrical properties of Examples 4-6 are more stable than those of Comparative Examples 2-3.

In conclusion, by using titanium carbide having a residual oxygen content greater than 0.3 wt % based on the weight of the titanium carbide particles as the conductive filler in the PTC material composition of this invention, the conductivity of the PTC material can be considerably increased as compared to the conductive filler of carbon black, and the aforesaid drawback of unstable electrical property associated with the prior art can be eliminated.

While the present invention has been described in connection with what are considered the most practical and preferred embodiments, it is understood that this invention is not limited to the disclosed embodiments but is intended to cover various arrangements included within the spirit and scope of the broadest interpretation and equivalent arrangements.

What is claimed is:

1. A PTC material composition for making a PTC circuit protection device, comprising:

a PTC polymer unit; and a conductive filler containing a plurality of titanium carbide particles;

wherein said titanium carbide particles have a residual oxygen content greater than 0.3 wt % based on the weight of said titanium carbide particles.

2. The PTC material composition of claim 1, wherein said residual oxygen content of said titanium carbide particles is greater than or equal to 0.5 wt % and less than 1.0 wt % based on the weight of said titanium carbide particles.

3. The PTC material composition of claim 1, wherein said titanium carbide particles are formed by carbiding a mixture containing a titanium-containing material and a carbon-containing material under a carbiding temperature ranging from 1700° C. to 2000° C.

4. The PTC material composition of claim 3, wherein said titanium-containing material is selected from the group consisting of titanium dioxide, titanium tetrachloride, titanium hydride, ferro titanium ore, titanium and combinations thereof.

5. The PTC material composition of claim 4, wherein said titanium-containing material is titanium dioxide.

6. The PTC material composition of claim 3, wherein said carbon-containing material is selected from the group consisting of carbon black, graphite and a combination thereof.

7. The PTC material composition of claim 1, wherein said PTC polymer unit includes a polyolefin blend.

8. The PTC material composition of claim 7, wherein said polyolefin blend includes non-grafted HDPE and carboxylic acid anhydride grafted HDPE.

9. The PTC material composition of claim 1, wherein said PTC polymer unit is in an amount ranging from 10-30 wt % based on the weight of said PTC material composition, and said conductive filler is in an amount ranging from 70-90 wt % based on the weight of said PTC material composition.

10. The PTC material composition of claim 1, wherein said conductive filler further contains a powder of an auxiliary conductive material selected from the group consisting of zirconium carbide, vanadium carbide, niobium carbide, tantalum carbide, chromium carbide, molybdenum carbide, tungsten carbide, titanium nitride, zirconium nitride, vanadium nitride, niobium nitride, tantalum nitride, chromium nitride, titanium disilicide, zirconium disilicide, niobium disilicide, tungsten disilicide, gold, silver, copper, aluminum, nickel, nickel-metallized glass beads, nickel-metallized graphite, Ti—Ta solid solution, W—Ti—Ta—Cr solid solution, W—Ta solid solution, W—Ti—Ta—Nb solid solution, W—Ti—Ta solid solution, W—Ti solid solution, Ta—Nb solid solution, and combinations thereof.

11. The PTC material composition of claim 10, wherein said auxiliary conductive material is nickel powder.

12. A PTC circuit protection device, comprising:

a PTC material layer; and two electrodes attached to said PTC material layer;

wherein said PTC material layer has a PTC material composition that includes a PTC polymer unit and a conductive filler containing a plurality of titanium carbide particles;

wherein said titanium carbide particles have a residual oxygen content greater than 0.3 wt % based on the weight of said titanium carbide particles.

13. The PTC circuit protection device of claim 12, wherein said residual oxygen content of said titanium carbide particles is greater than or equal to 0.5 wt % and less than 1.0 wt % based on the weight of said titanium carbide particles.

* * * * *